US007081574B1

(12) United States Patent
Smith

(10) Patent No.: US 7,081,574 B1
(45) Date of Patent: Jul. 25, 2006

(54) KIT FOR APPLYING SURFACE INDICIA TO A GUITAR BODY

(76) Inventor: Michael Smith, 1921 Traditions Ct., Franklin, IN (US) 46131

( * ) Notice: Subject to any disclaimer, the term of this patent is extended or adjusted under 35 U.S.C. 154(b) by 17 days.

(21) Appl. No.: 10/899,724

(22) Filed: Jul. 27, 2004

(51) Int. Cl.
*G10D 3/00* (2006.01)

(52) U.S. Cl. ..... 84/291; 84/453

(58) Field of Classification Search ..... 84/291, 84/453, 267, 327
See application file for complete search history.

(56) References Cited

U.S. PATENT DOCUMENTS

| | | | | |
|---|---|---|---|---|
| 3,251,258 | A | 5/1966 | Parker | 84/453 |
| 4,088,050 | A | 5/1978 | Appel | 84/267 |
| 4,334,452 | A | 6/1982 | Morrison, III et al. | 84/723 |
| 4,815,355 | A | 3/1989 | Cavaness | 84/291 |
| D380,228 | S | 6/1997 | Ferguson | |
| 5,747,711 | A | 5/1998 | Cavaness et al. | 84/291 |
| 2002/0152659 | A1* | 10/2002 | Hartill | 40/661 |
| 2003/0015083 | A1* | 1/2003 | Godin et al. | 84/453 |
| 2003/0164080 | A1* | 9/2003 | Childress | 84/291 |

* cited by examiner

*Primary Examiner*—Marlon Fletcher
*Assistant Examiner*—Jianchun Qin

(57) ABSTRACT

A kit for customizing an instrument includes a template that has a shape of a guitar body and is provided with an opening for positioning a guitar neck therethrough. The template includes a bottom surface, a side portion contiguous with the bottom surface, a lip portion for receiving a guitar body thereon, and springs for selectively maintaining the guitar body spaced above the bottom surface. A support section is connected to the bottom surface and is shaped to resemble a pick guard. Labels are attachable to a guitar pick guard by pressing same against the support section. A plurality of protrusions help maintain the guitar body spaced from the label after the guitar is positioned on the template so that a user can selectively align the guitar body with the label prior to pressing same against the pick guard.

13 Claims, 5 Drawing Sheets

KIT FOR APPLYING SURFACE INDICIA TO A GUITAR BODY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to instrument customizing kits and, more particularly, to a kit for applying surface indicia to a guitar body.

2. Prior Art

Bodies for solid body electric guitars, electric basses and similar instruments have heretofore normally been formed from a solid piece of wood or by laminating together several pieces of wood. In order to obtain a quality acoustic response and an aesthetically pleasing appearance, it has been necessary to use fairly high quality grades of maple, mahogany and other hard woods for these guitar bodies and there has been significant amounts of time and labor in carving the wood to the proper shape and dimensions, routing or otherwise forming recesses to receive pickups and other electronic hardware, staining and finishing the instrument, polishing the instrument and the like.

In all cases, the final body was either painted, clear lacquered, or some type of plastic coating, such as colored fiberglass, was used to produce the color of the final product. This means the bodies must be sanded and recoated to change the color. This is an expensive and time consuming process and sometimes even affects the sound. Most guitar players are stuck with one color or are forced to buy more than one guitar if they wish to have more than one color. Many professional musicians have 20 or 30 or more guitars, all of different colors. This tends to create storage, as well as transportation problems when they are on tour.

Many young guitar players also like to have various psychedelic colors on their guitars, which is not in high demand, thus increasing the cost of guitars for those just starting out. This can act as a deterrent, instead of encouraging, to young and new musicians in the field.

Accordingly, a need remains for a kit to apply surface indicia on a guitar body, while overcoming the above-noted shortcomings.

BRIEF SUMMARY OF THE INVENTION

In view of the foregoing background, it is therefore an object of the present invention to provide a kit for applying surface indicia on a guitar body. These and other objects, features, and advantages of the invention are provided by a kit for customizing an instrument, wherein the kit includes a template that has a general shape of a select guitar body and is provided with an opening for positioning a guitar neck therethrough.

The template includes a substantially planar bottom surface, a side portion contiguous with the bottom surface and extending upwardly therefrom in a substantially orthogonal direction, and a lip portion spaced inwardly from the side portion that has a non-linear shape for receiving a guitar body thereon. The side portion preferably has opposed end portions spaced apart at a select distance for defining a width of the template opening.

The template further includes a first plurality of resilient spring members that have opposed end portions connected to the bottom surface and the lip portion respectively. Such spring members selectively maintain the guitar body spaced above the bottom surface during operating conditions. The kit may further include a second plurality of resilient spring members that have opposed end portions connected to the plurality of protrusions and beneath the bottom surface respectively.

The template also includes a support section preferably disposed adjacent the template opening, and connected to the bottom surface. Such a support section is shaped as a select guitar pick guard. Of course, various pick guard shapes can be employed by the present inventions such as a Fender Stratocaster pick guard, for example. A plurality of extrusions extend upwardly through the support section and are spaced along the pick guard. Such protrusions are resiliently movable along a vertical plane between lowered and raised positions. A plurality of pegs are connected to the support member and extend downwardly therefrom so the support member can be maintained above the bottom surface and below the lip portion.

The kit further includes at least one label including a top layer for receiving surface indicia thereon. In a preferred embodiment, such a label is removably positionable on the support section and has a bottom adhesive layer attachable to the guitar body when the guitar is pressed downwardly against the support member. In an alternate embodiment, the label may not include an adhesive layer. Rather, it is affixed to a guitar pick guard by positioning a customized cover plate over the label. The cover plate is secured to the pick guard via conventional fastening members and is preferably formed from transparent material so the label indicia can be viewed from an exterior thereof.

The label is provided with a plurality of apertures for receiving corresponding fastening members therethrough after being affixed to the guitar body. Advantageously, the plurality of protrusions help maintain the guitar body spaced from the label after the guitar is positioned on the template so that a user can selectively align the guitar body with the label during operating conditions.

It is noted that graphic software is included with the kit to assist a user in custom-designing unique indicia on their labels. Furthermore, a printer suitable for applying surface indicia on the labels is required so that each label can be created during a single pass through the printing process.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
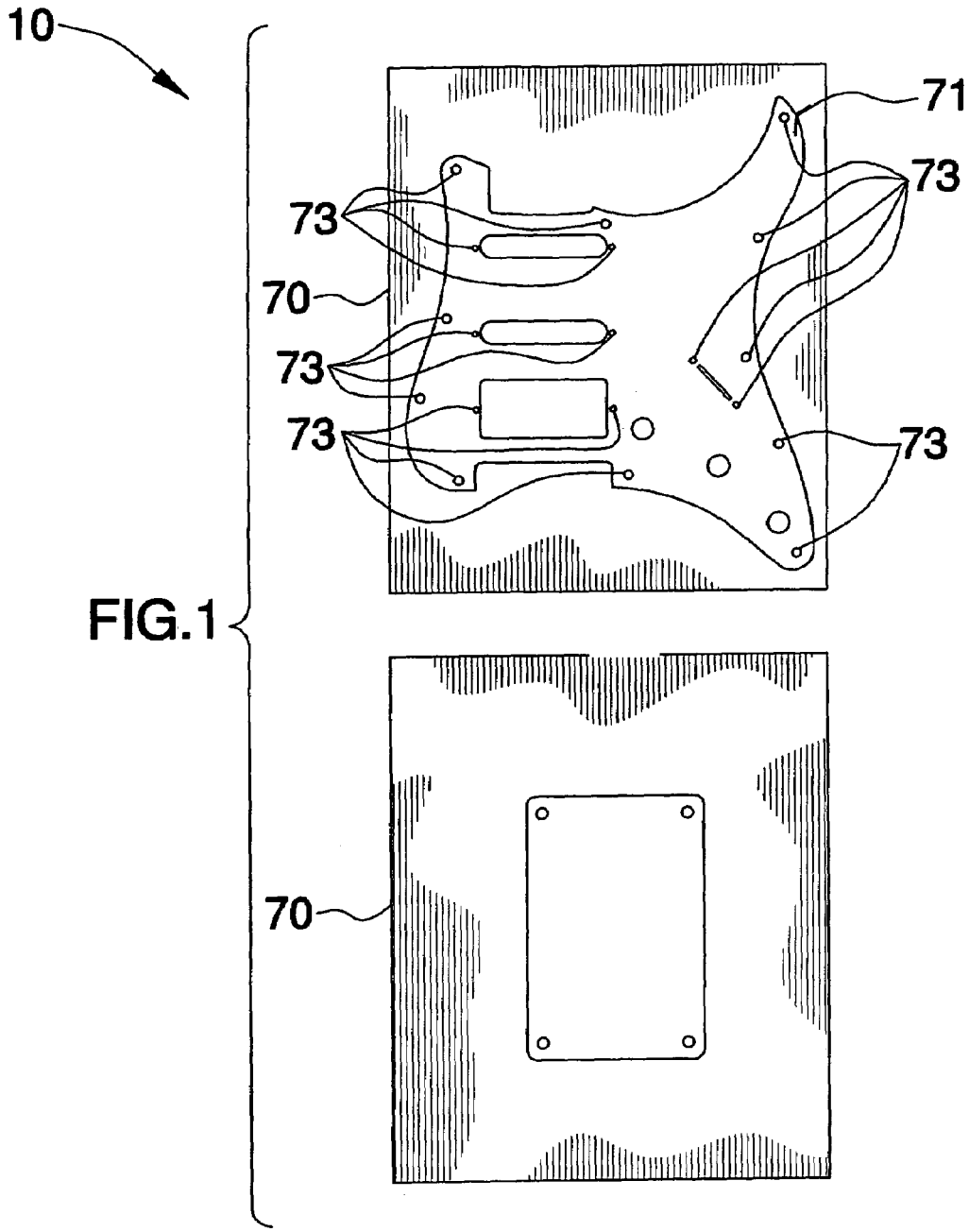
FIG. 1 is a top plan view showing the front and rear surfaces of pick guard label, in accordance with the present invention.
Figure 2:
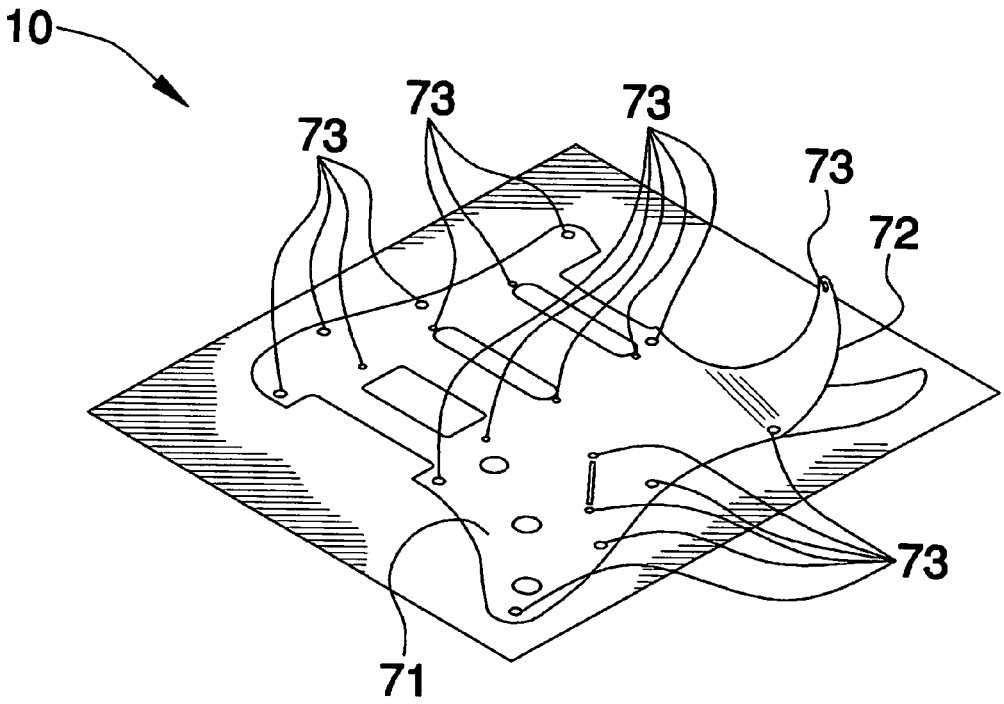
FIG. 2 is an enlarged perspective view showing a preferred embodiment of the label, which includes an adhesive bottom layer.
Figure 3:
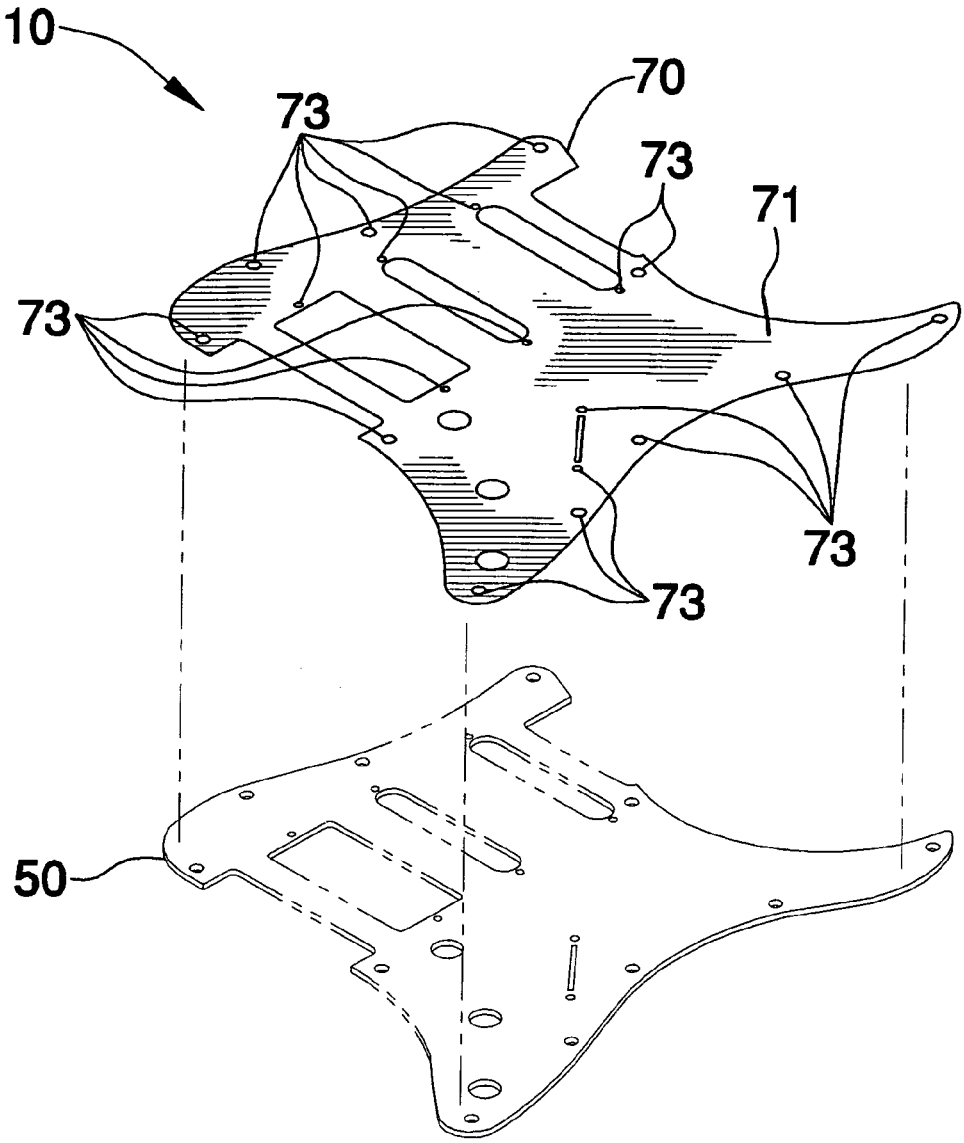
FIG. 3 is an enlarged perspective view showing the label positionable on a pick guard.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The kit of this invention is referred to generally in FIGS. 1–5 by the reference numeral 10 and is intended to apply surface indicia to a guitar body. It should be understood that the kit 10 may be used to apply indicia on various guitar pick guards and should not be limited to only Fender Stratocaster pick guards.

Figure 4:
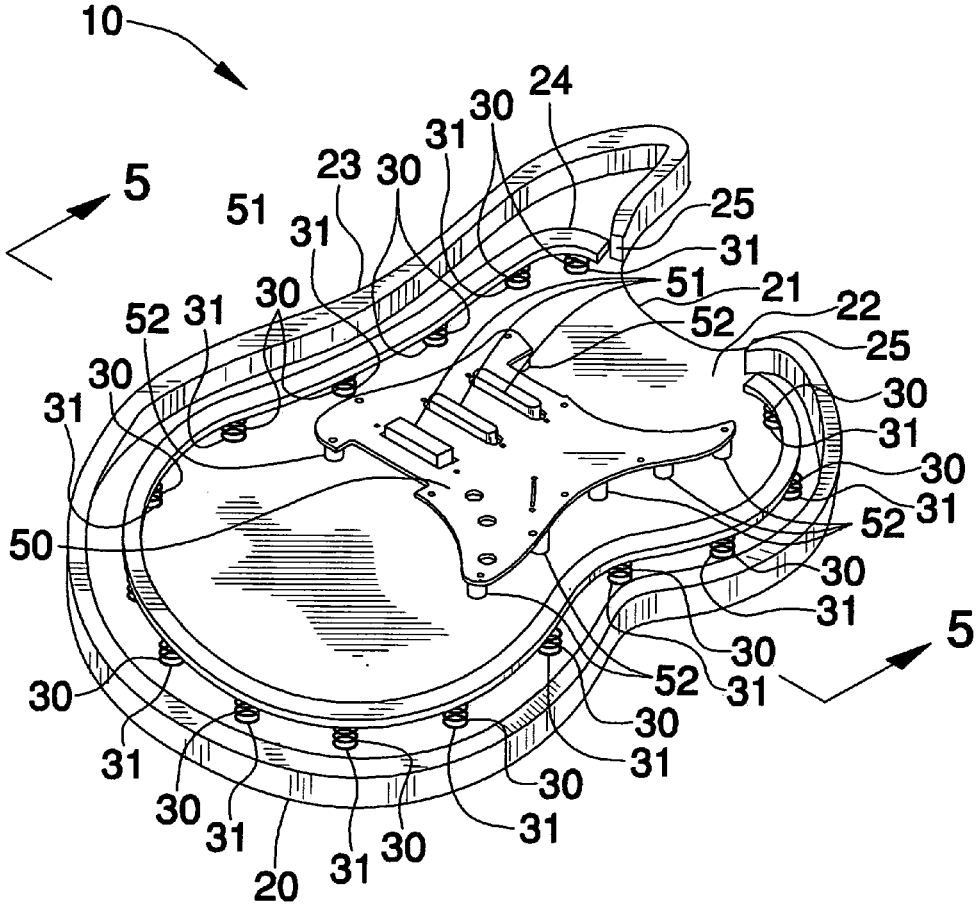
FIG. 4 is a perspective view showing the template employed by the present invention.
Figure 5:
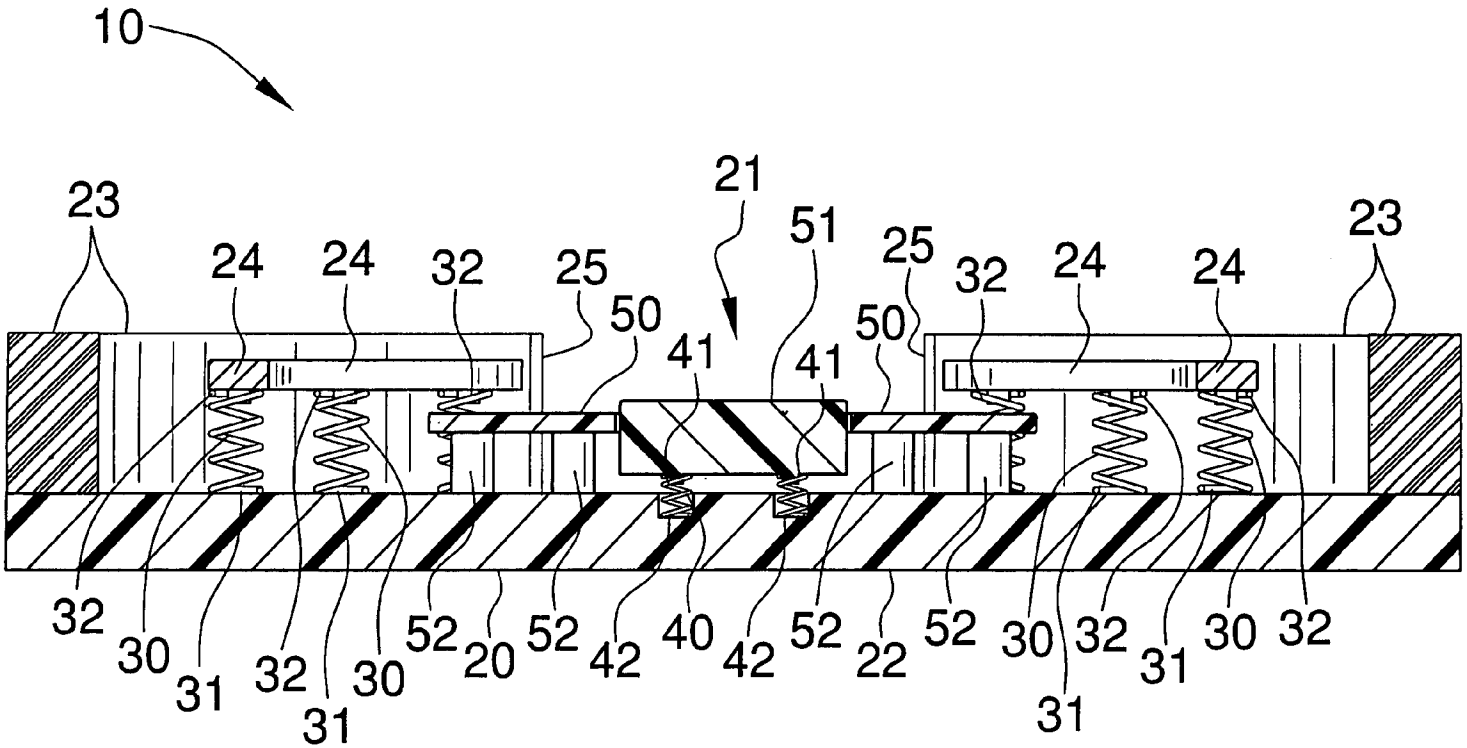
FIG. 5 is an enlarged cross-sectional view of the template shown in FIG. 1, taken along line 5—5.

Referring initially to FIGS. 4 and 5, the kit 10 includes a template 20 that has a general shape of a select guitar body (not shown) and is provided with an opening 21 for positioning a guitar neck (not shown) therethrough. The design of the template helps ensure a guitar will fit snuggly into the template for preventing the guitar from moving while the label 70 is applied, further ensuring that the label 70 is applied correctly.

The template 20 includes a substantially planar bottom surface 22, a side portion 23 contiguous with the bottom surface 22 and extending upwardly therefrom in a substantially orthogonal direction, and a lip portion 24 spaced inwardly from the side portion 23 that has a non-linear shape for receiving a guitar body (not shown) thereon. The side portion 23 has opposed end portions 25 spaced apart at a select distance for defining a width of the template 20 opening 21.

The template 20 further includes a first plurality of resilient spring members 30 that have opposed end portions 31, 32 connected to the bottom surface and the lip portion 24 respectively. Such spring members 30 selectively maintain the guitar body (not shown) spaced above the bottom surface 22 during operating conditions. The kit 10 further includes a second plurality of resilient spring members 40 that have opposed end portions 41, 42 connected to the plurality of protrusions 51 and beneath the bottom surface 22 respectively. The spring members 30, 40 allow an individual to exert downward pressure on a guitar while applying the label 70 without causing damage to the guitar's pick guard or body.

The template 20 also includes a support section 50 disposed adjacent the template opening 21, and is connected to the bottom surface 22. Such a support section 50 is shaped as a select guitar pick guard. Of course, various pick guards can be employed by the present inventions such as a Fender Stratocaster pick guard, for example, or other well-known pick guards. A plurality of extrusions 51 extend upwardly through the support section 50 and are spaced along the pick guard 60. Such protrusions 51 are resiliently movable along a vertical plane between lowered and raised positions. A plurality of pegs 52 are connected to the support member 50 and extend downwardly therefrom so the support member 50 can be maintained above the bottom surface 22 and below the lip portion 24.

The kit 10 further includes at least one label 70 including a top layer 71 for receiving surface indicia thereon. In a preferred embodiment, such a label 70 is removably positionable on the support section 50 and has a bottom adhesive layer 72 attachable to the guitar body (not shown) when the guitar is pressed downwardly against the support member 50. In an alternate embodiment, the label 70 may not include an adhesive layer 72. Rather, it is affixed to a guitar pick guard by positioning a customized cover plate (not shown) over the label. The cover plate is secured to the pick guard via conventional fastening members and is formed from transparent material so that the label indicia can advantageously be viewed from an exterior thereof.

The label 70 is provided with a plurality of apertures 73 for receiving corresponding fastening members therethrough after being affixed to the guitar body. Advantageously, the plurality of protrusions 51 help maintain the guitar body spaced from the label 70 after the guitar is positioned on the template 20 so that a user can selectively align the guitar body with the label 70 during operating conditions.

It is noted that graphic software is included with the kit to assist a user in custom-designing unique indicia on their labels. Furthermore, a printer suitable for applying surface indicia on the labels is required so that each label can be created during a single pass through the printing process.

The appealing features of the kit 10 are its convenience, ease of use, cost-effectiveness, and ability to create custom graphics for a variety of guitars. The kit 10 provides a simple, yet semi-permanent, way to customize one's guitar by simply using the provided software and the proper home printer. The kit 10 allows individuals to choose from a virtually unlimited number of designs for their guitar pick guards. This practical kit 10 will be appreciated by guitarists from the beginner level up to professional musicians.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A kit for customizing an instrument, said kit comprising:

a template having a general shape of a select guitar body and being provided with an opening for positioning a guitar neck therethrough, said template comprising a substantially planar bottom surface, a side portion contiguous with said bottom surface and extending upwardly therefrom in a substantially orthogonal direction, a lip portion spaced inwardly from said side portion and having a non-linear shape for receiving a guitar body thereon, a first plurality of resilient spring members having opposed end portions connected to said bottom surface and said lip portion respectively, said first plurality of spring members for selectively maintaining the guitar body spaced above said bottom surface during operating conditions, a support section connected to said bottom surface and having a shape of a select guitar pick guard, a plurality of protrusions extending upwardly through said support section and spaced therealong, said plurality of protrusions being resiliently movable along a vertical plane between lowered and raised positions;

at least one label comprising a top layer for receiving surface indicia thereon and being removably positionable on said support section, and a bottom adhesive layer attachable to the guitar body when the guitar is pressed downwardly against said support member;

wherein said plurality of protrusions help maintain the guitar body spaced from said at least one label after the guitar is positioned on said template so that a user can selectively align the guitar body with said at least one label during operating conditions; and a plurality of pegs connected to said support member and extending downwardly therefrom so that said support member can be maintained above said bottom surface and below said lip portion.

2. The kit of claim 1, further comprising: a second plurality of resilient spring members having opposed end portions connected to said plurality of protrusions and being disposed beneath said bottom surface respectively.

3. The kit of claim 1, wherein said at least one label is provided with a plurality of apertures for receiving corresponding fastening members therethrough after being affixed to the guitar body.

4. The kit of claim 1, wherein said support member is disposed adjacent said template opening.

5. The kit of claim 1, wherein said side portion has opposed end portions spaced apart at a select distance for defining a width of said template opening.

6. A kit for customizing an instrument, said kit comprising:

a template having a general shape of a select guitar body and being provided with an opening for positioning a guitar neck therethrough, said template comprising a substantially planar bottom surface, a side portion contiguous with said bottom surface and extending upwardly therefrom in a substantially orthogonal direction, a lip portion spaced inwardly from said side portion and having a non-linear shape for receiving a guitar body thereon, a first plurality of resilient spring members having opposed end portions connected to said bottom surface and said lip portion respectively, said first plurality of spring members for selectively maintaining the guitar body spaced above said bottom surface during operating conditions, a support section connected to said bottom surface and having a shape of a select guitar pick guard, a plurality of protrusions extending upwardly through said support section and spaced therealong, said plurality of protrusions being resiliently movable along a vertical plane between lowered and raised positions; at least one label comprising a top layer for receiving surface indicia thereon and being removably positionable on said support section, and a bottom adhesive layer attachable to the guitar body when the guitar is pressed downwardly against said support member;

wherein said plurality of protrusions help maintain the guitar body spaced from said at least one label after the guitar is positioned on said template so that a user can selectively align the guitar body with said at least one label during operating conditions;

a second plurality of resilient spring members having opposed end portions connected to said plurality of protrusions and being disposed beneath said bottom surface respectively; and a plurality of pegs connected to said support member and extending downwardly therefrom so that said support member can be maintained above said bottom surface and below said lip portion.

7. The kit of claim 6, wherein said at least one label is provided with a plurality of apertures for receiving corresponding fastening members therethrough after being affixed to the guitar body.

8. The kit of claim 6, wherein said support member is disposed adjacent said template opening.

9. The kit of claim 6, wherein said side portion has opposed end portions spaced apart at a select distance for defining a width of said template opening.

10. A kit for customizing an instrument, said kit comprising;

a template having a general shape of a select guitar body and being provided with an opening for positioning a guitar neck therethrough, said template comprising a substantially planar bottom surface, a side portion contiguous with said bottom surface and extending upwardly therefrom in a substantially orthogonal direction, a lip portion spaced inwardly from said side portion and having a non-linear shape for receiving a guitar body thereon, a first plurality of resilient spring members having opposed end portions connected to said bottom surface and said lip portion respectively, said first plurality of spring members for selectively maintaining the guitar body spaced above said bottom surface during operating conditions, a support section connected to said bottom surface and having a shape of a select guitar pick guard, a plurality of protrusions extending upwardly through said support section and spaced therealong, said plurality of protrusions being resiliently movable along a vertical plane between lowered and raised positions;

at least one label comprising a top layer for receiving surface indicia thereon and being removably positionable on said support section, and a bottom adhesive layer attachable to the guitar body when the guitar is pressed downwardly against said support member;

wherein said plurality of protrusions help maintain the guitar body spaced from said at least one label after the guitar is positioned on said template so that a user can selectively align the guitar body with said at least one label during operating conditions;

a second plurality of resilient spring members having opposed end portions connected to said plurality of protrusions and being disposed beneath said bottom surface respectively; and a plurality of pegs connected to said support member and extending downwardly therefrom so that said support member can be maintained above said bottom surface and below said lip portion.

11. The kit of claim 10, wherein said at least one label is provided with a plurality of apertures for receiving corresponding fastening members therethrough after being affixed to the guitar body.

12. The kit of claim 10, wherein said support member is disposed adjacent said template opening.

13. The kit of claim 10, wherein said side portion has opposed end portions spaced apart at a select distance for defining a width of said template opening.

* * * * *